US007469650B2

(12) United States Patent
Jordan et al.

(10) Patent No.: US 7,469,650 B2
(45) Date of Patent: Dec. 30, 2008

(54) METHOD AND APPARATUS FOR OFF-HULL MANUFACTURE AND INSTALLATION OF A SEMI-MEMBRANE LNG TANK

(75) Inventors: David L. Jordan, Pawcatuck, CT (US); William E. Michaud, Noank, CT (US)

(73) Assignee: National Steel and Shipping Company, San Diego, CA (US)

( * ) Notice: Subject to any disclaimer, the term of this patent is extended or adjusted under 35 U.S.C. 154(b) by 0 days.

(21) Appl. No.: 11/353,222

(22) Filed: Feb. 14, 2006

(65) Prior Publication Data

US 2007/0186834 A1 Aug. 16, 2007

(51) Int. Cl.
*B63B 25/08* (2006.01)

(52) U.S. Cl. ..... 114/74 A; 137/376; 220/560.08; 220/560.07; 62/53.2

(58) Field of Classification Search ..... 114/65 R, 114/74 A, 74 R, 75, 76; 220/560.04, 560.07, 220/560.08, 560.11, 560.12, 560.15, 565; 137/376
See application file for complete search history.

(56) References Cited

U.S. PATENT DOCUMENTS

| | | | |
|---|---|---|---|
| 2,911,125 | A | 11/1959 | Dosker |
| 3,071,094 | A | 1/1963 | Leroux |
| 3,273,740 | A | 9/1966 | Herrenschmidt |
| 3,380,611 | A | 4/1968 | Brougham et al. |
| 3,425,583 | A | 2/1969 | Bridges |
| 3,509,848 | A | 5/1970 | Salmon |
| 3,547,302 | A | 12/1970 | Jackson et al. |
| 3,767,150 | A | 10/1973 | Tabata |
| 3,814,361 | A | 6/1974 | Gabron et al. |
| 3,827,136 | A | 8/1974 | Yamamoto |
| 3,841,253 | A | 10/1974 | Kircik et al. |
| 3,861,021 | A | 1/1975 | Yamamoto |
| 3,899,988 | A | 8/1975 | Menendez |
| 3,908,574 | A | 9/1975 | Miller et al. |
| 3,937,353 | A | 2/1976 | Becker et al. |
| 3,941,272 | A | 3/1976 | McLaughlin |

(Continued)

FOREIGN PATENT DOCUMENTS

| | | |
|---|---|---|
| JP | 53140617 | 12/1978 |

(Continued)

OTHER PUBLICATIONS

Transportation of Liquefied Natural Gas, Sep. 1977.

*Primary Examiner*—Lars A Olson
(74) *Attorney, Agent, or Firm*—Kaye Scholer, LLP.

(57) ABSTRACT

The invention pertains generally to manufacturing and installing a semi-membrane tank for liquefied natural gas (LNG). Specifically, the invention relates to a method and apparatus for facilitating off-hull manufacturing of a completed semi-membrane LNG tank and installation of the tank in a permanent supporting structure, such as a ship's hull. Embodiments of the invention include attaching a support structure to the top and the sides of an LNG tank and attaching a support net to the support structure. The support net may be configured to support the bottom of the tank including any insulation that may be applied to the bottom. Once the support structure and support net are attached to the tank, the tank may then be moved from an assembly location to a permanent support structure where it may be permanently attached.

7 Claims, 6 Drawing Sheets

U.S. PATENT DOCUMENTS

| | | | | |
|---|---|---|---|---|
| 3,968,764 | A | 7/1976 | Kvamsdal et al. | |
| 3,987,925 | A | 10/1976 | Sattelberg | |
| 4,013,030 | A | 3/1977 | Stafford | |
| 4,173,936 | A | 11/1979 | Secord et al. | |
| 4,181,235 | A | 1/1980 | Baysinger | |
| 4,207,827 | A | 6/1980 | Gondouin | |
| 4,223,797 | A | 9/1980 | Skakunov | |
| 4,225,054 | A | 9/1980 | Jean | |
| 4,640,328 | A * | 2/1987 | Arney | 220/565 |
| 4,672,906 | A | 6/1987 | Asai | |
| 5,099,779 | A | 3/1992 | Kawaichl et al. | |
| 5,263,603 | A | 11/1993 | McBride | |
| 5,338,383 | A | 8/1994 | Polackowyj | |
| 5,355,819 | A | 10/1994 | Hsia et al. | |
| 5,363,787 | A | 11/1994 | Konopasek et al. | |
| 5,531,178 | A | 7/1996 | Abe et al. | |
| 5,727,492 | A | 3/1998 | Cuneo et al. | |
| 6,619,502 | B2 | 9/2003 | Walther et al. | |
| 6,626,319 | B2 | 9/2003 | Miller et al. | |
| 6,971,537 | B2 | 12/2005 | Enright, Jr. | |
| 7,111,750 | B2 | 9/2006 | Gulati et al. | |
| 2003/0057214 | A1 | 3/2003 | Miller et al. | |
| 2003/0066834 | A1 * | 4/2003 | Enright | 220/9.4 |
| 2004/0188446 | A1 | 9/2004 | Gulati et al. | |
| 2005/0139595 | A1 | 6/2005 | Pepin-Lehalleur et al. | |

FOREIGN PATENT DOCUMENTS

| | | |
|---|---|---|
| WO | WO 2005/093315 | 10/2005 |

* cited by examiner

METHOD AND APPARATUS FOR OFF-HULL MANUFACTURE AND INSTALLATION OF A SEMI-MEMBRANE LNG TANK

FIELD OF THE INVENTION

This invention relates to a method and apparatus for manufacturing and installing a semi-membrane tank for liquefied natural gas (LNG). Specifically, the invention relates to a method and apparatus for facilitating off-hull manufacturing of a completed semi-membrane LNG tank and installation of the tank in a permanent supporting structure.

BACKGROUND OF THE INVENTION

In many conventional manufacturing methods for membrane-type LNG tanks installed in ships or other permanent support structures, tank sections must be separately manufactured at an off-site location and transported for separate installation in a ship's cargo hold or other permanent support structure. Often, the separate sections must be transported with fixtures or assembling devices. After transportation, each section is welded to other partial tank sections in sequence until the entire tank has been assembled in the permanent support structure.

During installation of these tanks, temporary staging and support bracing is required and access to the space between the outside of the tank and the ship's hull must be provided while the sections are being welded together and tank insulation is applied. In addition, internal pumps, piping and tank monitoring systems must be installed before final tank closure and testing. Furthermore, allowance must be made for thermal contraction and expansion of the tank with respect to the ship's hull or permanent support structure.

Such piece by piece erection and installation of a membrane-type LNG tank structure within a ship's hull results in a complicated ship design and an extended shipbuilding schedule. Moreover, when there is a close fit between the LNG tank and the ship's inner hull, access to certain parts of the tank may be restricted and the number of personnel who may simultaneously access the tank to complete the installation may be limited. Furthermore, an attempt to both build the ship and construct the LNG tank within the ship complicates construction and restricts access to necessary building resources such as cranes, welding and ventilation.

One previous attempt at constructing an entire membrane-type LNG tank outside a vessel or support structure includes attaching a temporary support structure to the sides of the tank and attaching a pipe tower between the top and bottom of the tank during manufacture and assembly of the tank. The pipe tower must be placed in the geometric center of the tank and, in order to sufficiently support the tank bottom during movement to the ship, wire ropes or other support devices must be installed from the tower to a uniform pattern of pads welded to the inside of the tank bottom. The tank may then be moved to an installation site, using the temporary support carriage, the pipe tower and the wire ropes to support the tank during the move. The tank may then be installed in a ship's hull or other permanent support structure and the temporary support carriage and wire ropes may be removed.

However, this previous method has given rise to many problems which have not been solved satisfactorily. For example, due to the flexibility of the unstiffened membrane-type bottom, insulation may not be applied to the bottom of the tank until it has been installed in the ship's hull because the insulation lacks the flexibility to move with the flexible bottom during movement and installation of the tank. Therefore, insulation may only be applied to the sides and top of the tank prior to installation of the tank inside the ship's hull. The insulation to be used for insulating the bottom of the tank must be installed to the top surface of a ship's double bottom prior to installation of the tank and, upon installation of the completed tank within the ship's cargo hold, the lower radiused portion of the tank may then be attached to the insulation using a flexible make-up piece.

Additionally, due to the extreme flexibility of the unstiffened tank bottom and the danger of excessive deformation of the bottom plate during lifting and handling, the pipe tower must be located at the geometric center of the tank in order to obtain adequate support of the bottom during lifting and movement of the tank. However, locating the pipe tower at the center of the tank may complicate stripping of LNG from the tank prior to tank inspection or maintenance. Furthermore, upon installation within the ship's cargo hold, the wire ropes attached to the pipe tower and the tank bottom during manufacture and installation must be removed but the welded pads must remain inside the tank and these pads have the potential to begin cracks in the bottom of the tank.

Therefore, there is a need for a method and apparatus for facilitating off-hull manufacturing of a complete semi-membrane LNG tank and installation of the tank in a permanent supporting structure, thereby simplifying the process of manufacturing and installing the tank. Particularly, there is a need for a method and apparatus for manufacturing the tank which allows for attachment of insulation to the tank bottom prior to movement of the tank to and installation in a permanent support structure such as a ship's hull.

SUMMARY OF THE INVENTION

This invention relates to a method and apparatus for manufacturing and installing a semi-membrane tank for liquefied natural gas (LNG). Specifically, the invention relates to a method and apparatus for facilitating off-hull manufacturing of a complete semi-membrane LNG tank and installation of the tank in a permanent supporting structure.

One embodiment of the present invention may include a method of installing a semi-membrane LNG tank having a bottom, a top and at least one side wall. The method may include the steps of moving the tank to a supporting structure in a ship's hull and attaching the tank to the ship's hull. The step of moving the tank may include the steps of attaching a support structure to the top and a portion of the at least one side all of the tank and attaching a series of interconnecting straps to the support structure. The series of interconnecting straps may be configured to support the bottom of the semi-membrane LNG tank.

Another embodiment of the present invention may include a support structure for a semi-membrane LNG tank. The support structure may include a semi-membrane LNG tank having a bottom, a top and at least one side wall, a support structure connected to the top of the tank and at least a portion of the at least one side wall and a series of interconnecting straps affixed to said support structure and configured to provide support for the bottom of said tank. The support structure and said series of interconnecting straps may be configured to permit said tank to be moved from an assembly location to a ship's hull after said tank has been assembled.

These and other objects and advantages of the invention will be apparent from the following description, the accompanying drawings and the appended claims.

BRIEF DESCRIPTION OF THE DRAWINGS

While the specification concludes with claims particularly pointing out and distinctly claiming the present invention, it is believed the same will be better understood from the following description taken in conjunction with the accompanying drawings, which illustrate, in a non-limiting fashion, the best mode presently contemplated for carrying out the present invention, and in which like reference numerals designate like parts throughout the Figures, wherein:

DETAILED DESCRIPTION OF THE INVENTION

The present disclosure will now be described more fully with reference to the Figures in which various embodiments of the present invention are shown. The subject matter of this disclosure may, however, be embodied in many different forms and should not be construed as being limited to the embodiments set forth herein.

Figure 1A:
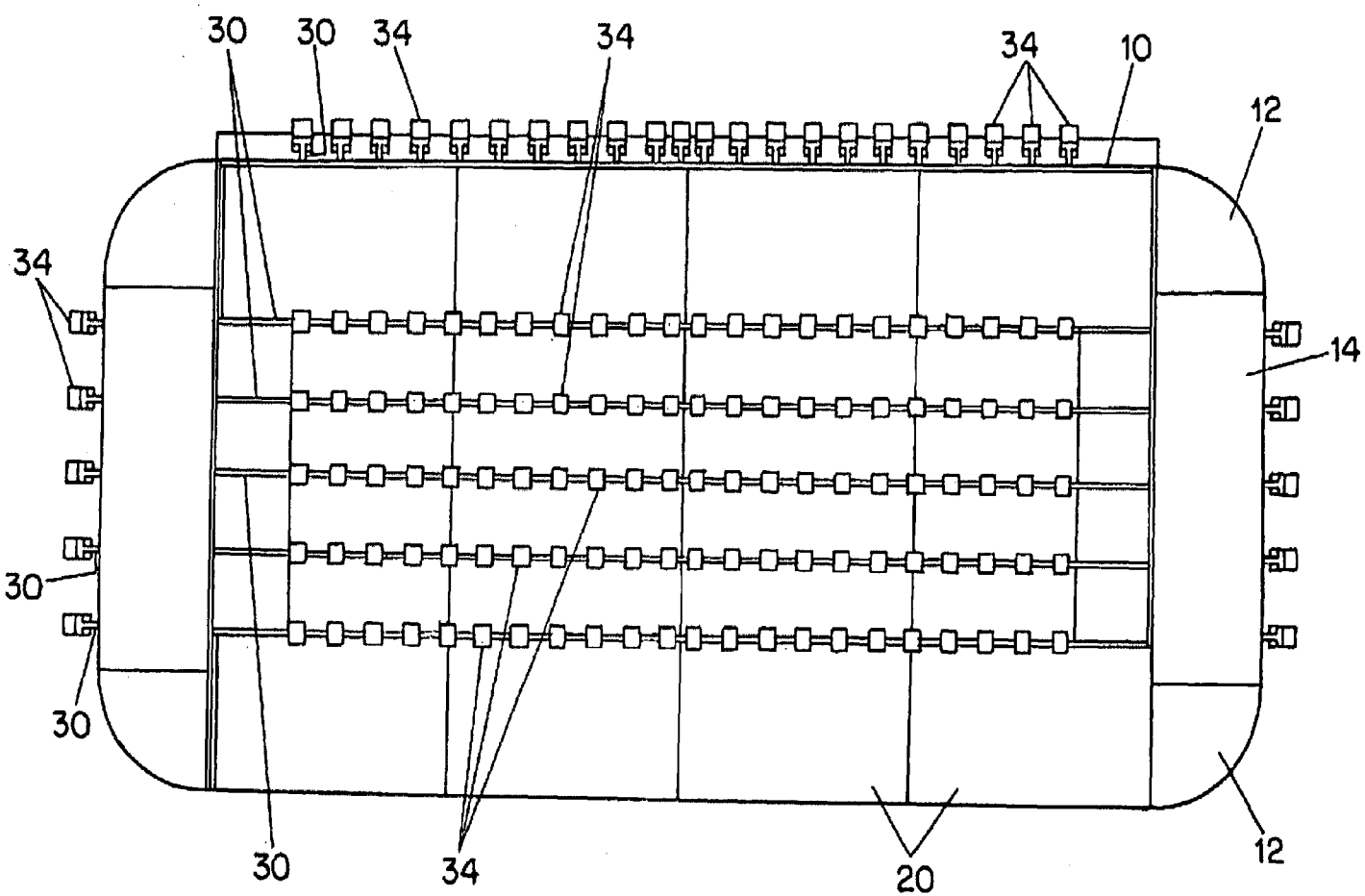
FIG. 1A (Prior Art)
FIG. 1A is a side view illustrating a typical prior art semi-membrane LNG tank.

FIG. 1A is a side view illustrating a typical prior art semi-membrane LNG tank 10. Such tanks are typically assembled from a plurality of prefabricated aluminum sheet sections such as sections 12, 14 and 20 illustrated in FIG. 1A. In most cases, the sections are joined along weld lines and have an arcuate shape between the weld lines which may allow for some thermal expansion and contraction of the tank 10 as a result of differences in temperature between when the tank is empty and full of liquefied natural gas or a similar substance which must be maintained at a very low temperature.

Typical semi-membrane tanks such as the tank 10 illustrated in FIG. 1A are generally not self-supporting even when empty and, therefore must be provided with support in order to avoid deformation or collapse. In the typical tank illustrated in FIG. 1A, T-shaped stiffening bars 30 may be affixed to the tank along weld lines or joints between adjacent segments. In one embodiment, the stiffening bars 30 may comprise aluminum, however any material or combination of materials with sufficient strength to support the arcuate segments is contemplated. Further, a plurality of load-bearing insulating support blocks 34 may be provided along the length of each of the stiffening bars 30 to provide support for the tank in the manner described below.

Figure 1B:
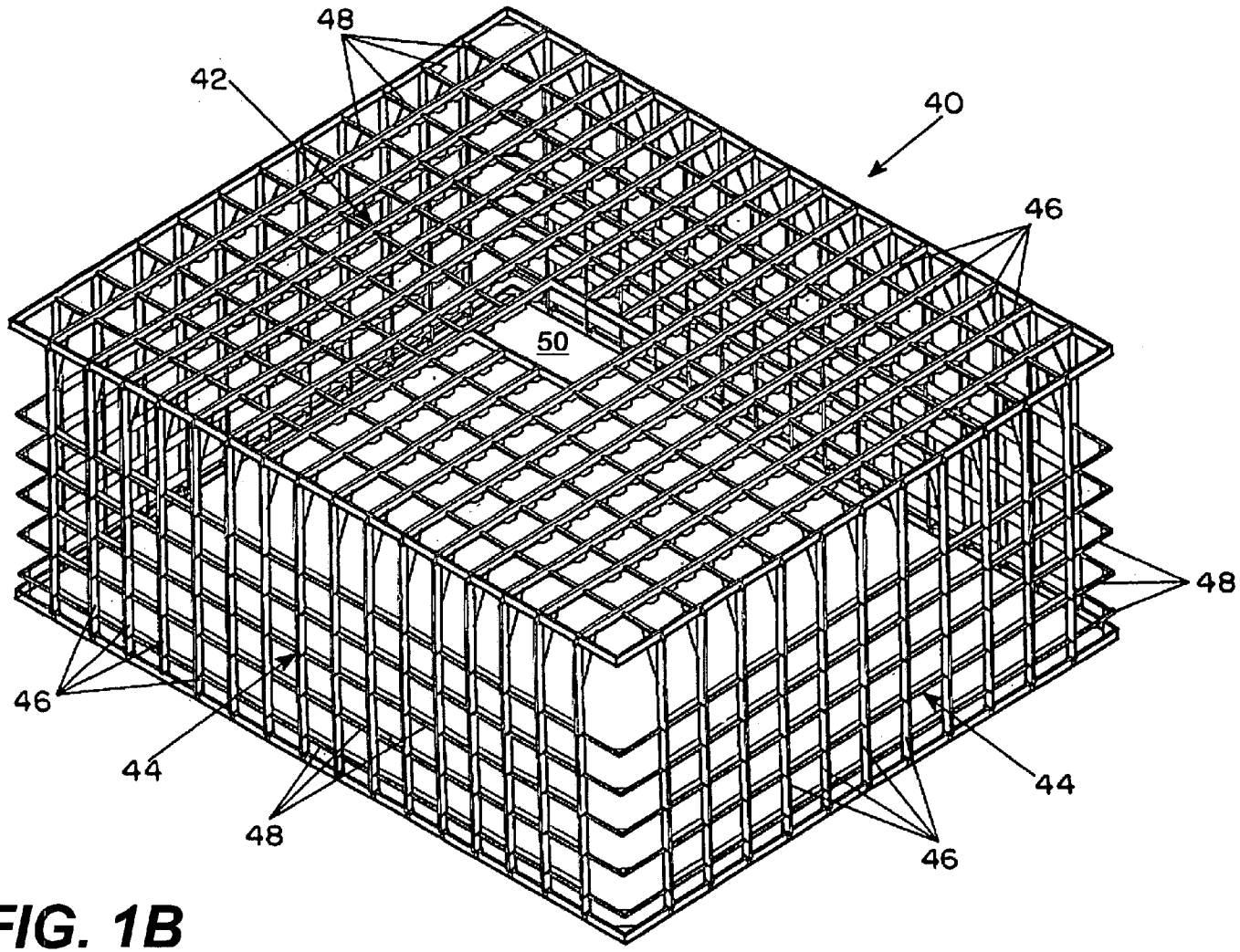
FIG. 1B (Prior Art)
FIG. 1B is a perspective view illustrating a typical support carriage used for supporting the sides and top of a semi-membrane LNG tank.

FIG. 1B is a perspective view illustrating a typical support carriage 40 used for supporting the sides and top of a semi-membrane LNG tank. The support carriage 40 may include a top frame section 42, side frame sections 44 and an open bottom. While the support carriage illustrated in FIG. 1B includes four side sections 44, any number of side sections may be used to accommodate different shapes of semi-membrane LNG tanks. Each frame section may be made of an array of orthogonally oriented beam members 46 and 48 which may be welded at their intersections to provide two-dimensional structural grids assembled in a three-dimensional form. In one embodiment of the present invention, the plurality of support blocks 34 attached to the tank 10 may also be attached at the intersection of the beam members 46.

The support carriage 40 may also include an opening 50 in the top frame section 42 to accommodate a pipe tower and tank dome, as discussed further below. While the support carriage shown in FIG. 1B illustrates the opening 50 in the top frame section 42 to be located in the geometric center of the support carriage 40, the present invention may allow for the opening 50 to be located at any location in the top frame section 42 to accommodate the placement of a pipe tower at any location within the semi-membrane LNG tank, as discussed below.

Figure 1C:
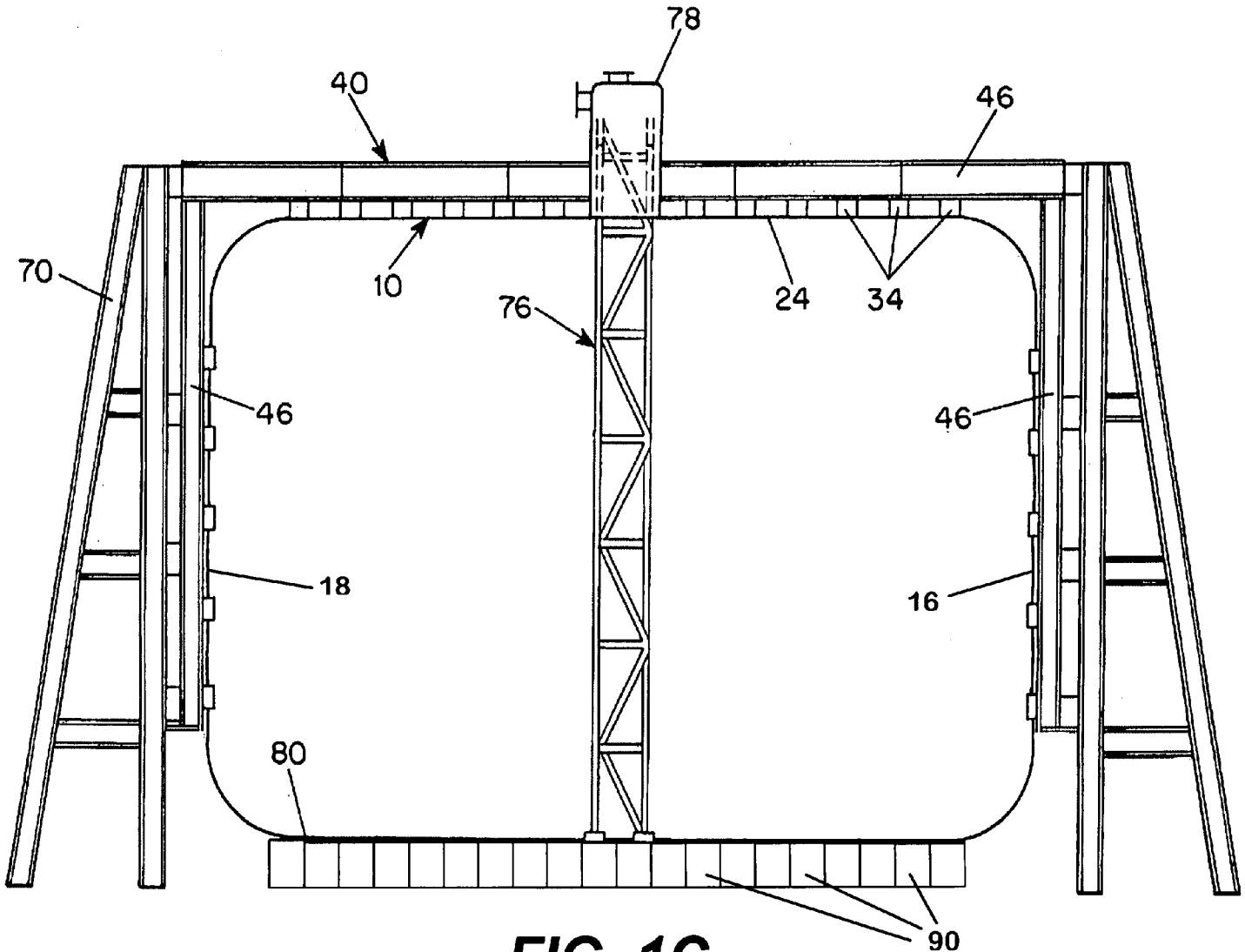
FIG. 1C is a cross-sectional view illustrating an erection and support arrangement used during erection and assembly of a semi-membrane LNG tank according to one embodiment of the present invention.

FIG. 1C is a cross-sectional view illustrating an erection and support arrangement used during erection and assembly of a semi-membrane LNG tank according to one embodiment of the present invention. Prior to the transfer of the tank 10 to a permanent support structure such as a ship's hull or a permanent structure in which it is to be installed, the illustrated erection and support arrangement may be utilized during manufacture and assembly of the tank 10. As illustrated in FIG. 1C, the tank erection and support arrangement may include the prior art support carriage 40 shown in FIG. 1B.

Similar to previous attempts at off-hull manufacture and assembly of semi-membrane tanks, the plurality of support blocks 34 attached to the sides of the tank 10 may be connected to the support carriage 40 to provide support to the top wall 24 of the tank 10 as well as to at least a portion of the sides 16 and 18 of the tank 10 while the tank 10 is being constructed. The support blocks 34 may be connected to the support carriage 40 using any conventional method including, for example, slidably interconnecting the support blocks 34 and the beam members 46.

Since the support blocks are typically fabricated from a material having low thermal conductivity and good mechanical properties (such as Lignostone), the method of attachment in the preferred embodiment may be a mechanical connection. For example, the externally stiffened side walls may be attached to the support carriage 40 through support assemblies which may provide support normal to the tank wall while still permitting movement of the assembly parallel to the tank wall. In one embodiment, each support assembly may include a bracket affixed to one of the support members 34 and a spool affixed to the stiffening bars 30 along with a grooved insulating block which in turn may be attached via a bracket to the support carriage 40. The spool piece may be bolted to the stiffening bars 30 while the bracket may be welded to the support carriage 40.

To provide lateral support for the tank 10 and the support carriage 40 during manufacture and assembly, the support carriage 40 may be surrounded by and slidably received within a temporary support structure 70. A pipe tower 76 and dome 78 may also be installed inside of the tank 10. While the pipe tower 76 and dome 78 are illustrated in FIG. 1C as being located at the geometric center of the tank 10, it is contemplated that it may be placed at any location inside the tank 10.

As discussed above, it may be preferable to locate the pipe tower 76 and dome 78 at a location off-center so as to allow for easier stripping of cargo from within the tank.

As discussed above, previous attempts at off-hull manufacture and assembly of semi-membrane LNG tanks included wire ropes connected between the pipe tower 76 and the bottom 80 of the tank 10. These wire ropes were required to support the bottom 80 of the tank 10 during manufacture and assembly of the tank 10. However, the present invention eliminates the need for these wire ropes and allows for the pipe tower 76 and dome 78 to be located at any location inside the tank 10. According to one embodiment of the present invention, temporary support blocks 90 may be placed under the bottom 80 of the tank 10. These temporary support blocks 90 may serve to support the bottom 80 of the tank 10 while the tank 10 is being manufactured and assembled.

Figure 3:
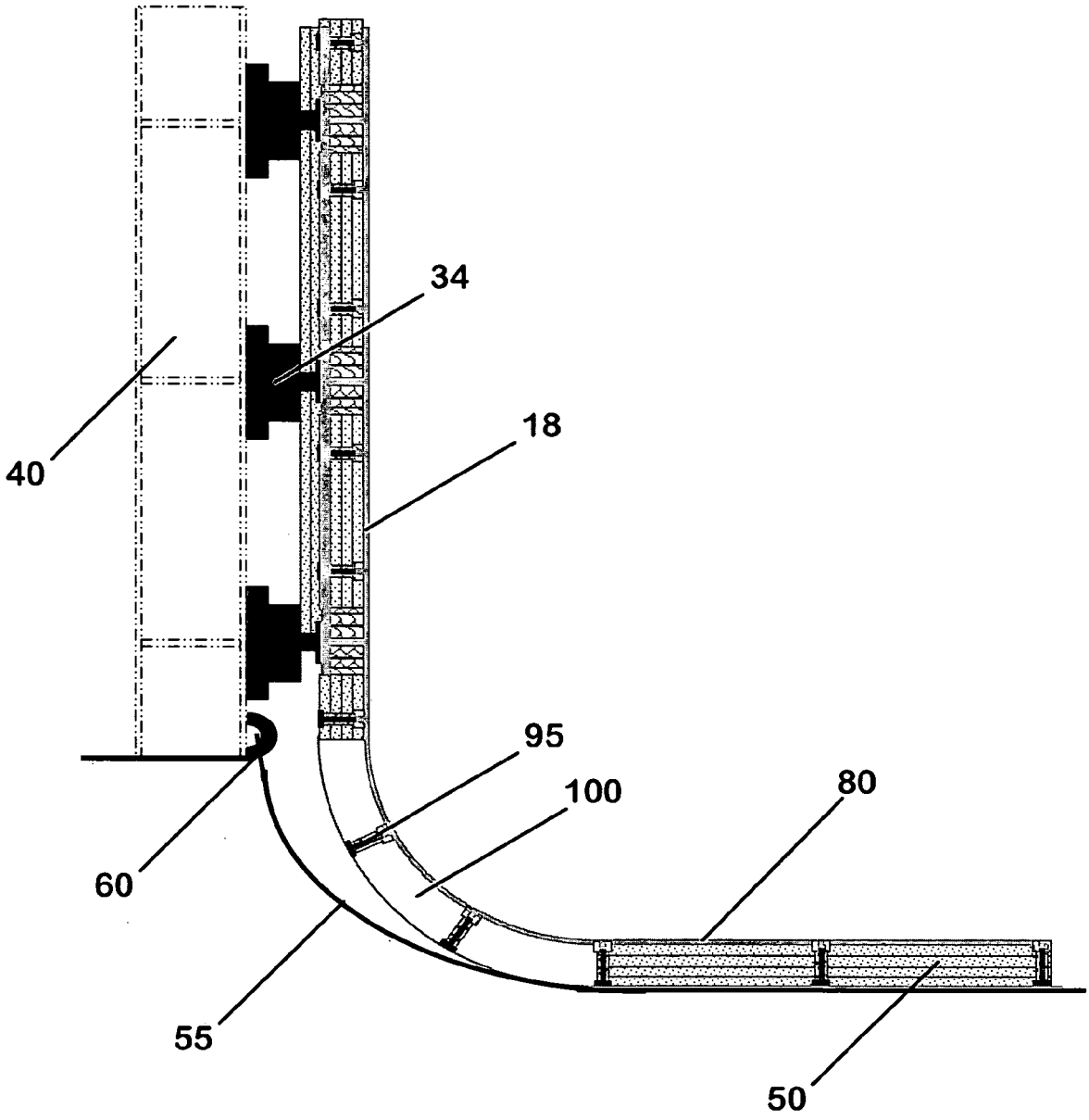
FIG. 3 is a cross-sectional view of the attachment of a support carriage and support net to a semi-membrane LNG tank according to one embodiment of the present invention.

Unlike previous attempts at off-hull manufacture and assembly of semi-membrane LNG tanks, the present invention allows for all welding and inspection of the tank to be completed at a manufacturing location while the tank 10 is attached to the support carriage 40 and supported by the support blocks 90. Further, as discussed above, prior art attempts at off-hull manufacture of semi-membrane LNG tanks do not permit the application of insulation to the bottom of the tank prior to installation of the tank in a permanent support structure. However, the present invention allows for insulation to be applied to the tank bottom 80, sides 16 and 18 and top 24 once inspection has been completed. An exemplary embodiment of the application of the insulation is illustrated in FIG. 3. As shown in FIG. 3, studs 95 may be shot into the tank's exterior and prefabricated blocks 100 of insulating material, such as polyurethane foam, may be applied to the bottom 80, sides 16 and 18 and top 24 of the tank 10. Additionally, the load bearing insulation blocks 34 may be constructed so as to provide a high level of insulation between the tank 10 and the support carriage structure 40.

Figure 2:
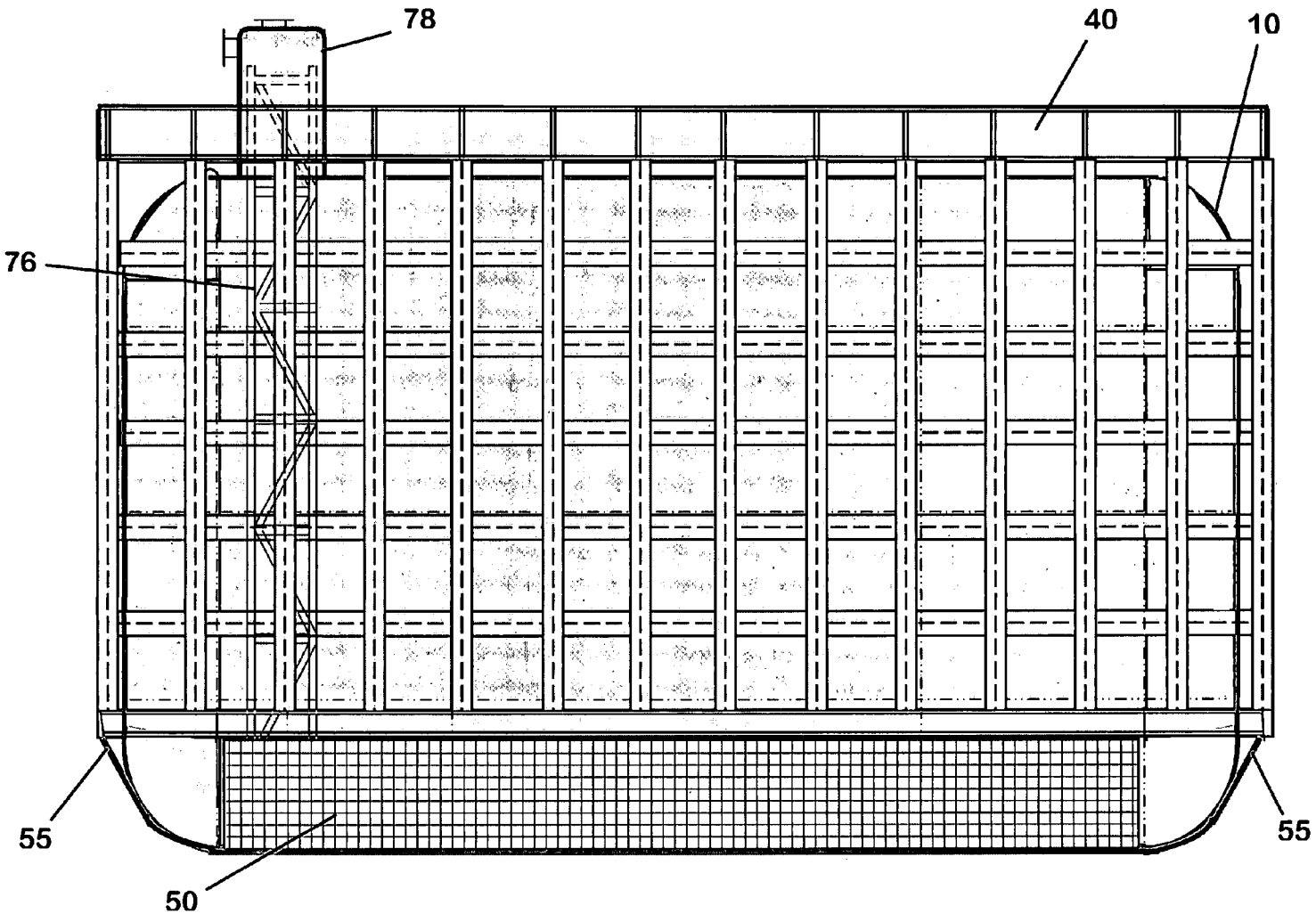
FIG. 2 is a sectional view illustrating a support arrangement used for supporting a semi-membrane LNG tank during movement of the tank according to one embodiment of the present invention.
Figure 4:
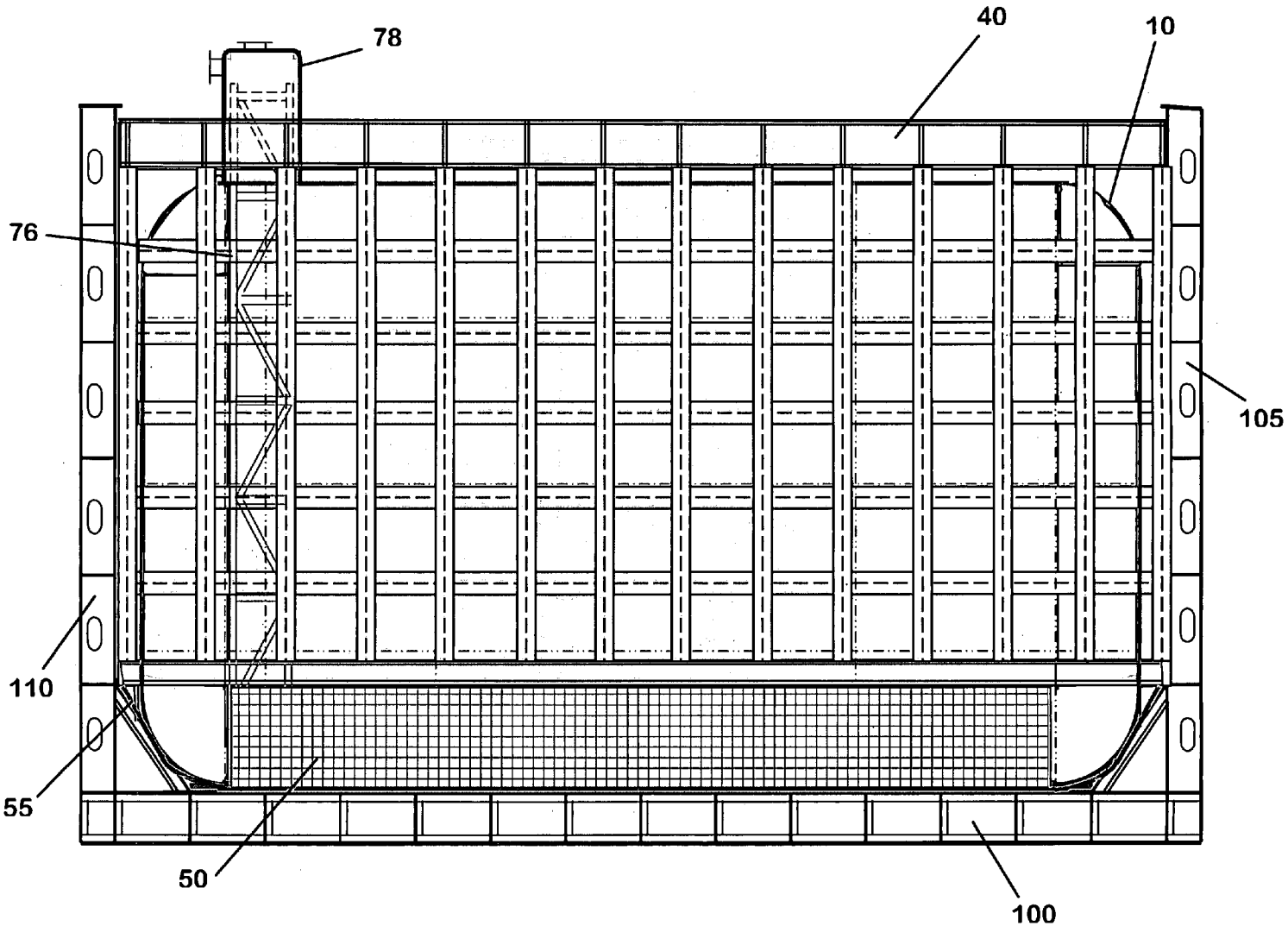
FIG. 4 is a sectional view illustrating the installation of a semi-membrane LNG tank in the hull of a ship or other permanent support structure according to one embodiment of the present invention.

FIG. 2 is a sectional view illustrating a support arrangement used for supporting a semi-membrane LNG tank during movement of the tank according to one embodiment of the present invention. Once the entire tank 10, including the bottom 80 and the lower radiused corners, has been insulated, a series of interconnecting straps may be installed beneath the tank bottom by removing and replacing the temporary support blocks 90 used for supporting the tank bottom during manufacture and assembly. The series of interconnecting straps may be spaced at any sufficient distance from each other so as to provide support for the tank bottom 80 and the insulation applied to the tank bottom during transportation of the tank from an assembly location to permanent supporting structure such as a ship's hull. In one exemplary embodiment, the interconnecting straps may be closely spaced, creating a support net 50, as illustrated in FIGS. 2–4.

Once the support net 50 has been properly positioned, the net 50 may be drawn up and attached to the support carriage 40. In the embodiment of the invention illustrated in FIG. 2, the support net 50 may be attached to the support carriage 40 using cables 55. The tension of the cables 55 may be adjustable using any known means for adjusting such as turnbuckles or pulleys.

FIG. 3 is a cross-sectional view of the attachment of a support carriage and support net to a semi-membrane LNG tank according to one embodiment of the present invention. As illustrated in FIG. 3, the cables 55 may be attached to the support carriage 40. While FIG. 3 illustrates the attachment of a cable 55 to support carriage 40 using a grommet 60, any known means for fastening may be employed in the present invention for attaching the cables 55 and support carriage 40.

Once the support net 50 has been installed beneath the tank bottom 80 and drawn up and attached to the support carriage 40, the tank may then be lifted and moved from its manufacturing and assembly location to a permanent support structure such as a ship's hull. The lifting of the tank 10 may be accomplished by lifting the support carriage 40 using a crane or any other means for lifting known in the art. Because the support net 50 is attached to the support carriage 40 using cables 55, upon lifting the support carriage 40, the support net 50 may simultaneously support and lift the tank bottom 80. The tank 10, support carriage 40 and support net 50 may be placed on a barge or a similar transporter for movement to a ship's hull. Thus, the entire insulated LNG tank 10 (including the insulated bottom 80) may be lifted and moved to a permanent support structure such as a ship's hull. Of course, when the tank 10 is being lifted and moved, the tank bottom 80 should be monitored for excessive deformation. If the bottom 80 is sagging excessively, the support net 50 may be tightened using cables 55 to limit the degree of deformation.

Once the tank 10 reaches a permanent support structure such as a ship's hull, the support carriage 40, net 50 and tank 10 may be lowered into and installed in the cargo hold. FIG. 4 is a sectional view illustrating the installation of a semi-membrane LNG tank in the hull of a ship or other permanent support structure according to one embodiment of the present invention. As shown in FIG. 4, the support carriage 40, net 50 and tank 10 may be installed between the walls 105 and 110 of the permanent support structure. The support carriage 40 may then be permanently attached to the walls 105 and 110 by welding or any other known means for permanently securing.

Once the completed tank has been installed in a ship's cargo hold or other permanent support structure, some or all of the beam members 46 and 48 of the support carriage 40 may be permanently attached to the vertical walls 105 and 110 of the support structure. The attachment may be accomplished by welding or any other means of permanently securing known in the art. With the bottom 80 of the tank 10 resting in the permanent support structure, the support net 50 may be loosened to relieve tension. Further, the support net 50 may be left in place beneath the tank bottom 80 since it will have no impact on the thermal efficiency of the tank 10 or the load bearing insulation supporting the tank 10.

The present invention provides significant advantages over prior art systems and methods for manufacturing and installing semi-membrane LNG tanks. As discussed above, the present invention allows for both the assembly of a membrane-type LNG tank and the application of insulation to the entire assembled tank, including the bottom. This may reduce the amount of time and work required for manufacturing and installing a complete insulated tank in a ship's cargo hold. Further, this may allow for the tank to be protected from weather and other elements during manufacture and assembly. Additionally, the present invention allows for the placement of the pipe tower and dome off-center in the tank, thereby reducing time required for stripping the tank of LNG.

The foregoing descriptions of specific embodiments of the present invention are presented for purposes of illustration and description. They are not intended to be exhaustive or to limit the invention to the precise forms disclosed. Obviously, many modifications and variations are possible in view of the above teachings. While the embodiments were chosen and described in order to best explain the principles of the invention and its practical applications, thereby enabling others skilled in the art to best utilize the invention, various embodiments with various modifications as are suited to the particular use are also possible. The scope of the invention is to be defined only by the claims appended hereto, and by their equivalents.

What is claimed is:

1. A method of installing a semi-membrane LNG tank having a bottom, a top and at least one side wall, the method comprising the steps of:

attaching a support structure to at least a portion of the tank;

attaching insulation to at least a portion of the bottom of the tank;

attaching a support net to the support structure, the support net being configured to support the bottom of the semi-membrane LNG tank;

moving the tank and the insulation on the bottom of the tank to a supporting structure in a ship's hull; and attaching the tank to the ship's hull.

2. The method of claim 1, wherein the support net is configured to substantially support the bottom of the tank and the insulation attached to the bottom of the tank.

3. The method of claim 1, wherein the support structure is attached to the top of the tank and the at least one side wall of the tank using load bearing support blocks.

4. An apparatus comprising:

a semi-membrane LNG tank having a bottom, a top and at least one side wall;

a support structure connected to the top of the tank and at least a portion of the at least one side wall;

insulation attached to at least a portion of the bottom of the tank; and a support net affixed to the support structure and configured to provide support for the bottom of the tank;

wherein the support structure and the support net are configured to permit the tank and the insulation on the bottom of the tank to be moved from an assembly location to a ship's hull after the tank has been assembled.

5. The apparatus of claim 4, wherein the tension of the support net is adjustable.

6. The apparatus of claim 4, wherein the insulation on the bottom of the tank is supported by the support net during transportation of the tank from an assembly location to a ship's hull.

7. The apparatus of claim 4, wherein the support structure is connected to the top and at least a portion at the at least one side wall of the tank by a plurality of load bearing insulating support blocks.

* * * * *